US011679433B2

(12) United States Patent
Kim et al.

(10) Patent No.: US 11,679,433 B2
(45) Date of Patent: Jun. 20, 2023

(54) PRESS MOLD FOR VEHICLE BODY PART

(71) Applicants: Hyundai Motor Company, Seoul (KR); Kia Corporation, Seoul (KR)

(72) Inventors: Sang Dong Kim, Gyeonggi-do (KR); Daero Lee, Gyeonggi-do (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 18 days.

(21) Appl. No.: 17/379,132

(22) Filed: Jul. 19, 2021

(65) Prior Publication Data

US 2022/0203426 A1 Jun. 30, 2022

(30) Foreign Application Priority Data

Dec. 29, 2020 (KR) ..... 10-2020-0186401

(51) Int. Cl.

| | |
|---|---|
| ***B21D 22/00*** | (2006.01) |
| ***B21D 22/06*** | (2006.01) |
| ***B21D 22/10*** | (2006.01) |
| ***B21D 37/10*** | (2006.01) |
| *B21D 53/88* | (2006.01) |

(52) U.S. Cl.

CPC ..... *B21D 22/06* (2013.01); *B21D 22/10* (2013.01); *B21D 37/10* (2013.01); *B21D 53/88* (2013.01)

(58) Field of Classification Search

CPC ..... B21D 22/06; B21D 22/10; B21D 24/04; B21D 24/08; B21D 24/14; B21D 37/10; B21D 22/22; B21D 53/88

See application file for complete search history.

(56) References Cited

U.S. PATENT DOCUMENTS

2021/0178446 A1* 6/2021 Ooka ..... B21D 37/12

* cited by examiner

*Primary Examiner* — Debra M Sullivan

(74) *Attorney, Agent, or Firm* — Fox Rothschild LLP

(57) ABSTRACT

A press mold includes: a lower die; an upper die; a lower holding unit including lower main pads and lower sub-pads respectively installed to be movable in an upper-lower direction on the lower body through first and second cushion springs, respectively, at an edge of a lower forming steel; an upper holding unit including upper main pads integrally connected to an edge of an upper forming steel in correspondence with the lower main pads and upper sub-pads installed to be respectively movable in the upper body in the upper-lower direction through third cushion springs at the edge of the upper forming steel in correspondence with the lower sub-pads; and a gap control assembly installed in a lower main block connected to the lower main pads to form a gap set between the lower main blocks and the upper sub-blocks connected to the upper sub-pads.

14 Claims, 16 Drawing Sheets

(a)

PRESS MOLD FOR VEHICLE BODY PART

CROSS-REFERENCE TO RELATED APPLICATION

This application claims under 35 U.S.C. § 119 the benefit of Korean Patent Application No. 10-2020-0186401, filed in the Korean Intellectual Property Office on Dec. 29, 2020, the entire contents of which are incorporated herein by reference.

BACKGROUND

(a) Technical Field

The present disclosure relates to a press mold, more particularly, to the press mold for forming a vehicle body part such as a door inner panel made of a non-ferrous material.

(b) Description of the Related Art

In general, in the vehicle industry, vehicle body parts made of non-ferrous materials such as aluminum and magnesium are used to reduce weight of a vehicle body in order to improve fuel efficiency.

An example of the body parts made of non-ferrous materials may include door inner panels made of aluminum. Such non-ferrous vehicle body parts may be press molded into a shape that is set through a press mold.

However, conventionally, since elongation of a non-ferrous material is lower than that of a steel material, there is a problem in that formability of a vehicle body part is low in press-molding a non-ferrous molded part such as a door inner panel as a one-piece blank plate through a press mold.

Accordingly, conventionally, a plurality of pieces of blank plate materials are press-molded into shapes that are set through each piece of press mold equipment, and vehicle body parts made of non-ferrous materials such as door inner panels are manufactured.

The above information disclosed in this Background section is only for enhancement of understanding of the background of the disclosure, and therefore it may contain information that does not form the prior art that is already known in this country to a person of ordinary skill in the art.

SUMMARY

The present disclosure provides a press mold capable of forming a vehicle body part as a non-ferrous part such as a door inner panel of a non-ferrous material as one piece.

An embodiment of the present disclosure provides a press mold including: i) a lower die provided with a lower forming steel on an upper surface of a lower body; ii) an upper die provided with an upper forming steel on a lower surface of an upper body; iii) a lower holding unit including lower main pads and lower sub-pads respectively installed to be movable in an upper-lower direction on the lower body through first and second cushion springs, respectively, at an edge of the lower forming steel; iv) an upper holding unit including upper main pads integrally connected to an edge of the upper forming steel in correspondence with the lower main pads and upper sub-pads installed to be respectively movable in the upper body in the upper-lower direction through third cushion springs at the edge of the upper forming steel in correspondence with the lower sub-pads; and v) a gap control assembly installed in a lower main block connected to the lower main pads to form a gap set between the lower main blocks and the upper sub-blocks connected to the upper sub-pads.

In the press mold according to an embodiment of the present disclosure, a cushion stroke of the lower main pads may satisfy a sum of cushion strokes of the lower sub-pads and the upper sub-pads.

In the press mold according to an embodiment of the present disclosure, the lower main pads may be disposed to face each other in a single direction with the lower forming steel therebetween.

In the press mold according to an embodiment of the present disclosure, the lower sub-pads may be disposed to face each other in another single direction that is perpendicular to the single direction with the lower forming steel therebetween.

In the press mold according to an embodiment of the present disclosure, the upper main pads may be disposed to face each other in a single direction with the upper forming steel therebetween.

In the press mold according to an embodiment of the present disclosure, the upper sub-pads may be disposed to face each other in another single direction that is perpendicular to the single direction with the upper forming steel therebetween.

In the press mold according to an embodiment of the present disclosure, the lower main pads may form a pad surface having a larger area than that of the lower sub-pads.

In the press mold according to an embodiment of the present disclosure, the upper main pads may form a pad surface having a larger area than that of the upper sub-pads.

In the press mold according to an embodiment of the present disclosure, the lower main blocks may be installed to be movable in the upper-lower direction on the lower body through the first cushion springs.

In the press mold according to an embodiment of the present disclosure, the lower sub-pads may be connected to the lower sub-blocks and the lower sub-blocks may be installed to be movable in an upper-lower direction on the lower body through the second cushion springs.

In the press mold according to an embodiment of the present disclosure, the upper sub-blocks may be installed to be movable in the upper-lower direction on the upper body through the third cushion springs.

In the press mold according to an embodiment of the present disclosure, when the upper die descends, the lower main blocks may descend by a larger cushion stroke than a cushion stroke of the lower sub-blocks, and the upper sub-blocks may be raised by a cushion stroke that is set by the lower sub-blocks.

In addition, the press mold according to an embodiment of the present disclosure may further include: switch touch blocks installed in the upper body; and a limit switch installed in the lower holding unit in correspondence with the switch touch block.

In the press mold according to an embodiment of the present disclosure, the gap control assembly may include: a base member installed in the lower main blocks in correspondence with opposite sides of the lower sub-blocks with the lower sub-blocks therebetween; an air cylinder installed in the base member to include an operation rod that operates forward and backward along a longitudinal direction of the lower sub-pads; and a moving block connected to the operation rod and installed to be movable back and forth on an upper surface of the base member.

In the press mold according to an embodiment of the present disclosure, the gap control assembly may further include a guide member installed on the upper surface of the base member to guide the moving block.

In the press mold according to an embodiment of the present disclosure, stopper plates may be installed at opposite sides of the upper sub-blocks to be in surface contact with a side surface of the moving block in a front-rear direction.

In the press mold according to an embodiment of the present disclosure, stopper blocks may be provided at opposite sides of the upper sub-blocks to be in surface contact with a side surface of the moving block in an up-down direction.

In the press mold according to an embodiment of the present disclosure, when the upper die is raised, the lower main blocks may maintain a predetermined gap with the upper sub-blocks by the moving block.

According to the embodiment of the present disclosure, unlike the conventional art in which a plurality of pieces of blank plates are molded through each piece of press mold equipment, a production cost may be reduced.

Further, effects that can be obtained or expected from embodiments of the present disclosure are directly or suggestively described in the following detailed description. That is, various effects expected from embodiments of the present disclosure will be described in the following detailed description.

BRIEF DESCRIPTION OF THE DRAWINGS

The drawings are intended to be used as references for describing the embodiments of the present disclosure, and the accompanying drawings should not be construed as limiting the technical spirit of the present disclosure.

DETAILED DESCRIPTION OF THE EMBODIMENTS

Figure 1:
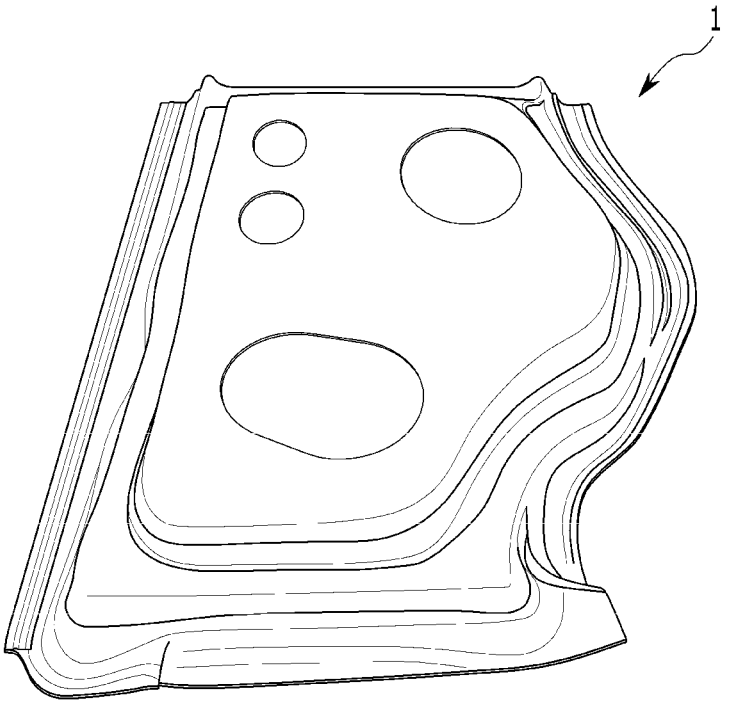
FIG. 1 schematically illustrates a vehicle body part formed by a press mold according to an embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example, both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, the present disclosure will be described more fully with reference to the accompanying drawings, in which embodiments of the disclosure are shown. As those skilled in the art would realize, the described embodiments may be modified in various different ways, all without departing from the spirit or scope of the present disclosure.

In order to clearly describe the present disclosure, parts that are irrelevant to the description are omitted, and identical or similar constituent elements throughout the specification are denoted by the same reference numerals.

Since the size and thickness of each configuration shown in the drawings are arbitrarily shown for convenience of description, the present disclosure is not necessarily limited to configurations illustrated in the drawings, and in order to clearly illustrate several parts and areas, enlarged thicknesses are shown.

In the following description, dividing names of components into first, second, and the like is to divide the names because the names of the components are the same, and an order thereof is not particularly limited.

Figure 2:
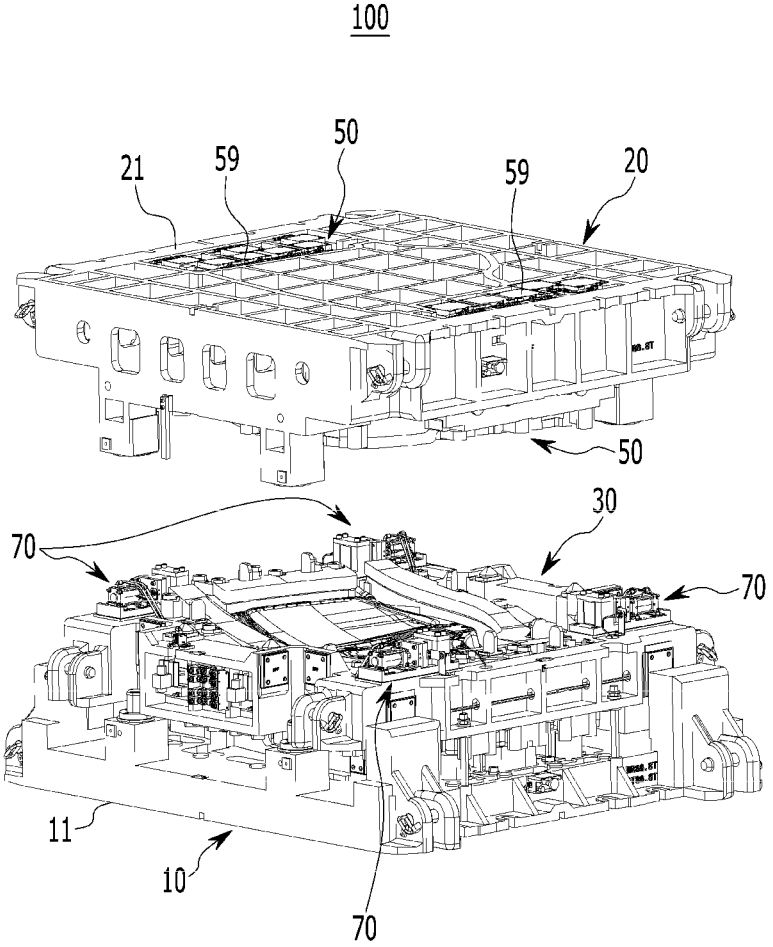
FIG. 2 illustrates a combined perspective view showing a press mold according to an embodiment of the present disclosure.

FIG. 1 schematically illustrates a vehicle body part formed by a press mold according to an embodiment of the present disclosure, and FIG. 2 illustrates a combined perspective view showing a press mold according to an embodiment of the present disclosure.

Referring to FIG. 1 and FIG. 2, the press mold 100 according to the present embodiment may be applied to a sub-assembly line for manufacturing a vehicle body part 1 such as a vehicle body panel in a vehicle body factory.

In the sub-assembly line, a press molding process, a trim process, a piercing process, a flange banding process, etc. are performed to form a raw material panel as a blank into a predetermined shape.

Furthermore, the press mold 100 according to the present embodiment may be applied to a process of press-molding a vehicle body part 1 of a non-ferrous material (e.g., an aluminum material), which is a non-ferrous material such as for a door inner panel, into a predetermined shape.

However, it should not be understood that the protection scope of the present disclosure is limited to a mold for molding the vehicle body part 1 such as a door inner panel, etc., and the technical idea of the present disclosure may be applied to a mold for molding panel parts of various types and uses.

The vehicle body part 1 in FIG. 1 is illustrated to have a shape that is obtained by press-molding a blank plate into a predetermined shape, and thus for the vehicle body part 1 and the blank plate, a front-rear direction is set as a reference direction, and a direction that is perpendicular to the front-rear direction is defined as a vertical direction.

However, the definitions of such directions are relative, and the direction may vary depending on the reference position of the vehicle body part 1 and the blank plate, and thus the reference direction is not necessarily limited to the reference direction of the present embodiment.

In addition, when following components are described based on the vertical direction for the press mold 100 according to an embodiment of the present disclosure, a portion facing a upper side is defined as an upper portion, an upper end, an upper surface, and an upper side portion, and a portion facing a lower side will be defined as a lower portion, a lower end, a lower surface, and a lower end portion.

Furthermore, the end (one side/one end or the other side/one end) in the following may be defined as either end or a certain portion (one side/one end or the other side/one end) including the end.

The press mold 100 according to an embodiment of the present disclosure has a structure capable of forming the vehicle body part 1 as a non-ferrous part such as a door inner panel made of a non-ferrous material into a single piece.

Figure 3:
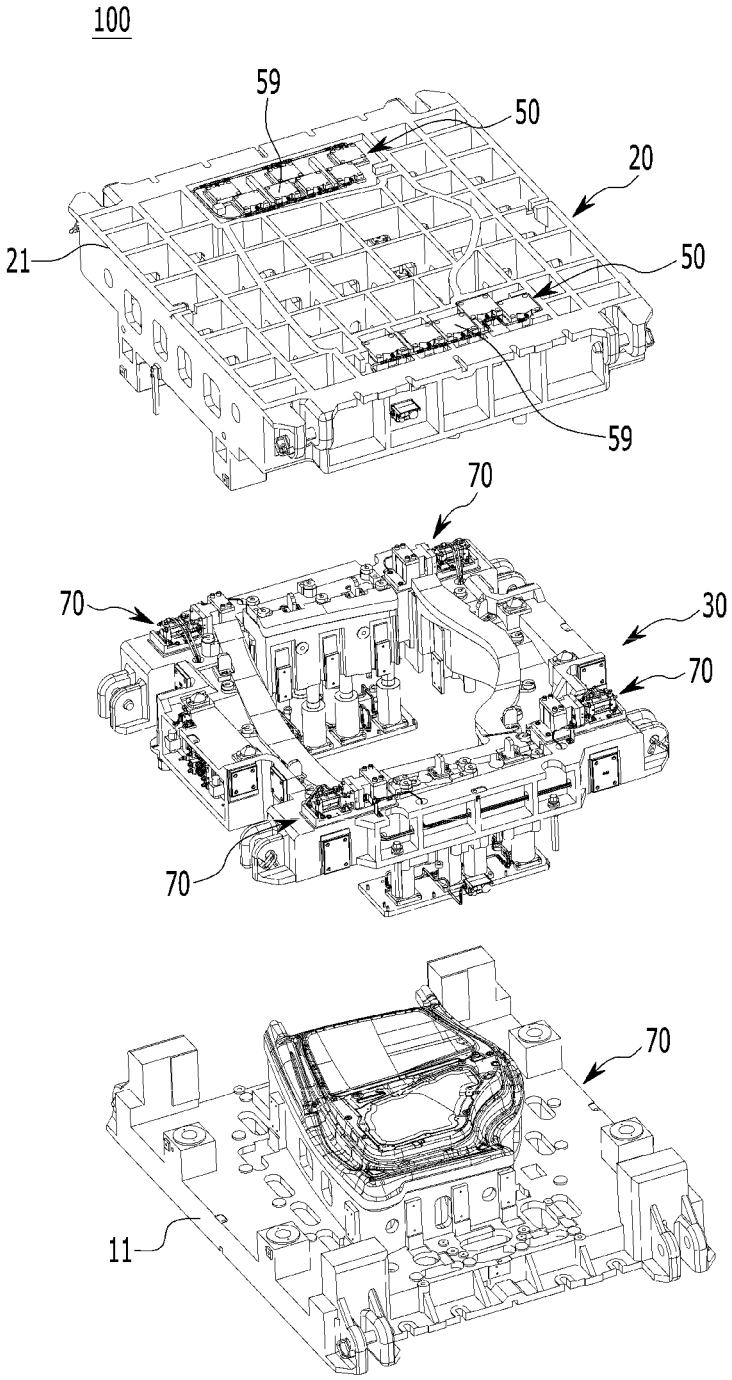
FIG. 3 and FIG. 4 illustrate exploded perspective views showing a press mold according to an embodiment of the present disclosure.
Figure 4:
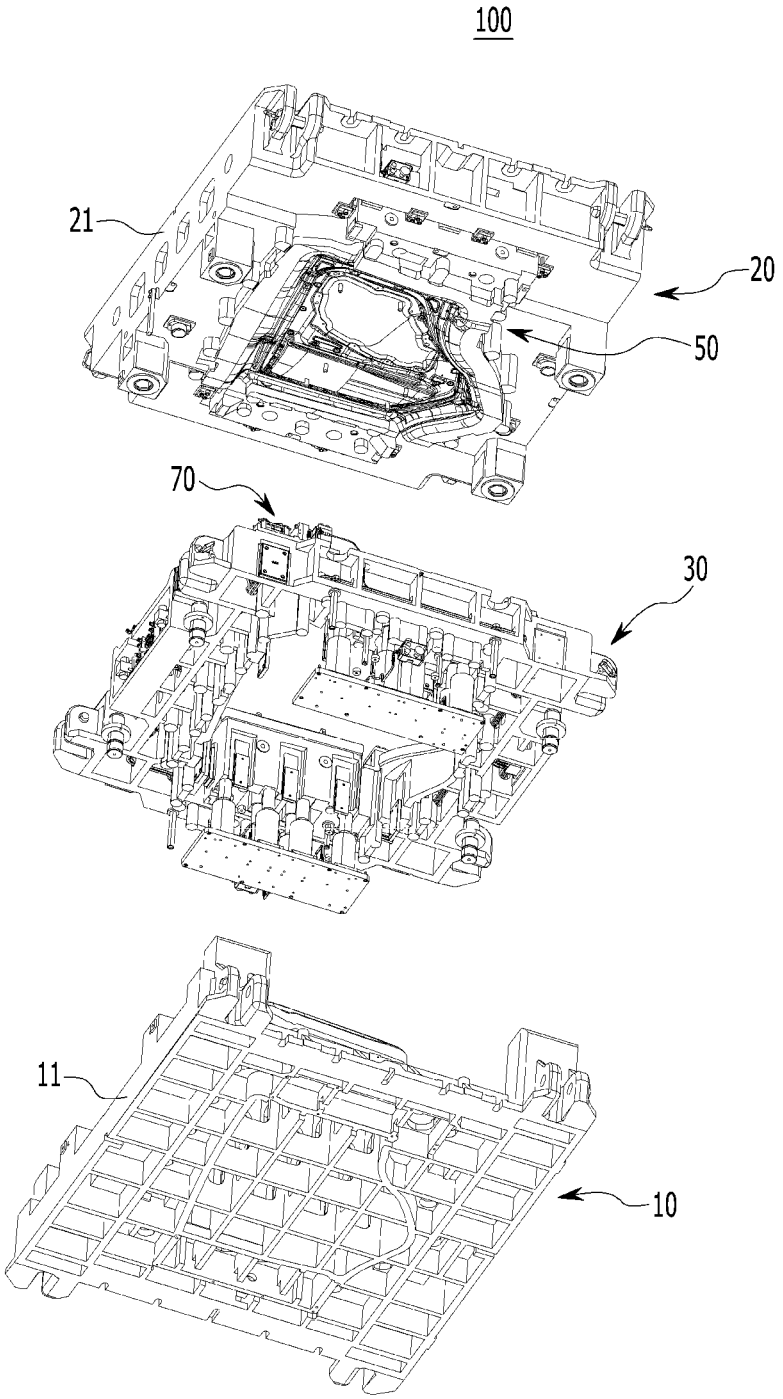
Figure 5:
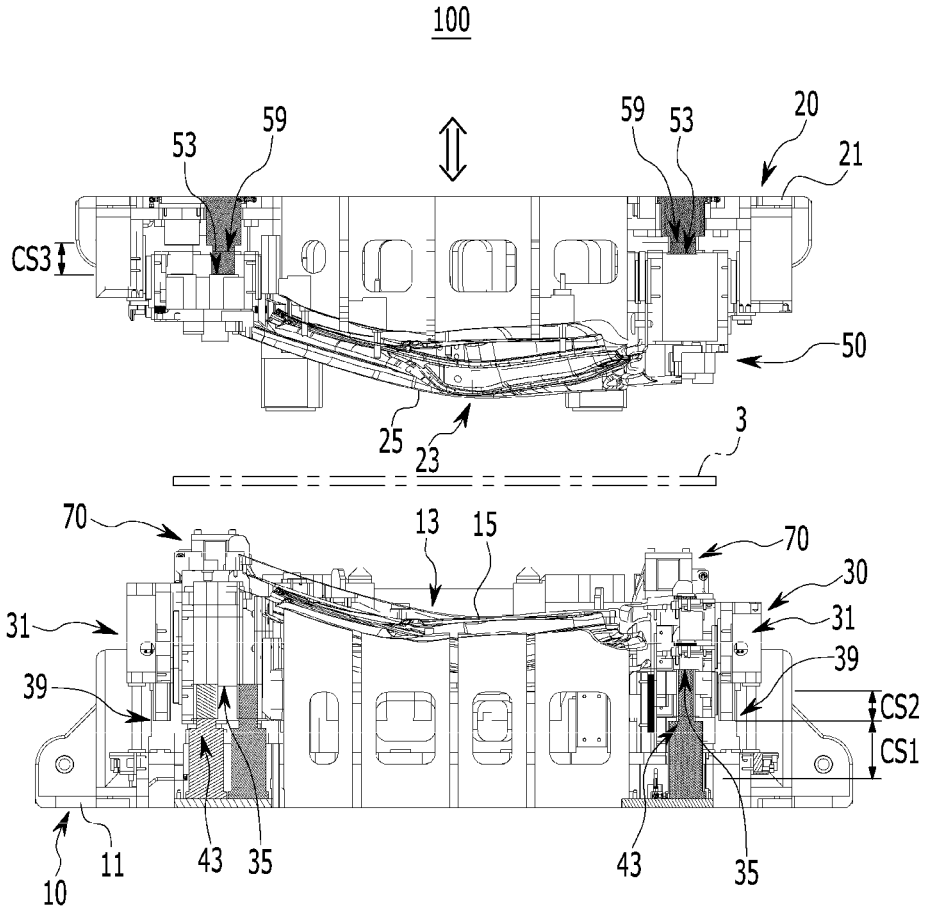
FIG. 5 illustrates a heteromorphic cross-sectional view showing a press mold according to an embodiment of the present disclosure.

FIG. 3 and FIG. 4 illustrate exploded perspective views showing a press mold according to an embodiment of the present disclosure, and FIG. 5 illustrates a heteromorphic cross-sectional view showing a press mold according to an embodiment of the present disclosure.

Referring to FIG. 1 to FIG. 5, the press mold 100 according to an embodiment of the present disclosure basically includes a lower die 10, an upper die 20, a lower holding unit 30, and an upper holding unit 50, and a gap control assembly 70.

In an embodiment of the present disclosure, the lower die 10 is fixedly installed on a bottom surface of a process work site, and includes a lower body 11 called a bolster in the art.

The lower body 11 may include various accessory elements such as brackets, rods, plates, blocks, bulkheads, ribs, etc. for supporting constituent elements to be described below. However, since the above-described various accessory elements are for installing each of the constituent elements to be described below to the lower body 11, the accessory elements are collectively referred to as the lower body 11 except for exceptional cases in the embodiment of the present disclosure.

Figure 6:
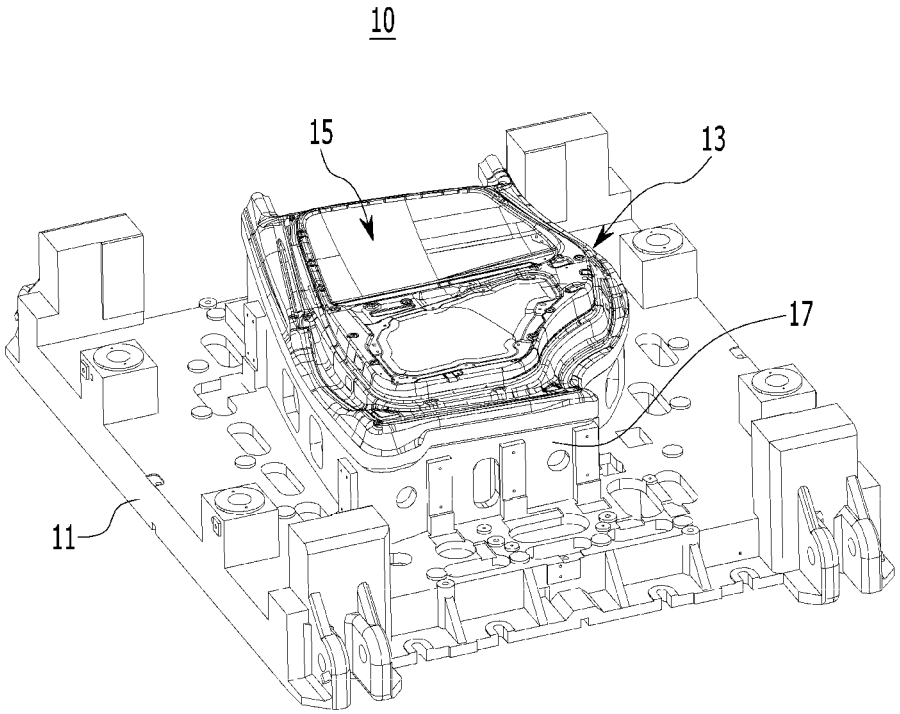
FIG. 6 illustrates a lower die applied to a press mold according to an embodiment of the present disclosure.

The lower die 10 includes a lower forming steel 13 provided on an upper surface of the lower body 11 as illustrated in FIG. 6. The lower forming steel 13 is formed by forming a blank plate 3 (see FIG. 5) into a predetermined shape, and has a lower forming surface 15 that forms a lower surface of the vehicle body part 1 (see FIG. 1) on an upper surface thereof. The lower forming steel 13 is installed on an upper surface of a mount base 17 at a center of an upper surface of the lower body 11.

In an embodiment of the present disclosure, the upper die 20 includes an upper body 21 that is movable in a vertical direction with respect to the lower die 10 through a slider (not illustrated) in a factory work site.

The upper body 21 may include various accessory elements such as brackets, rods, plates, blocks, bulkheads, ribs, etc. for supporting constituent elements to be described below. However, since the above-described various accessory elements are for installing each of the constituent elements to be described below to the upper body 21, the accessory elements are collectively referred to as the upper body 21 except for exceptional cases in the embodiment of the present disclosure.

Figure 7:
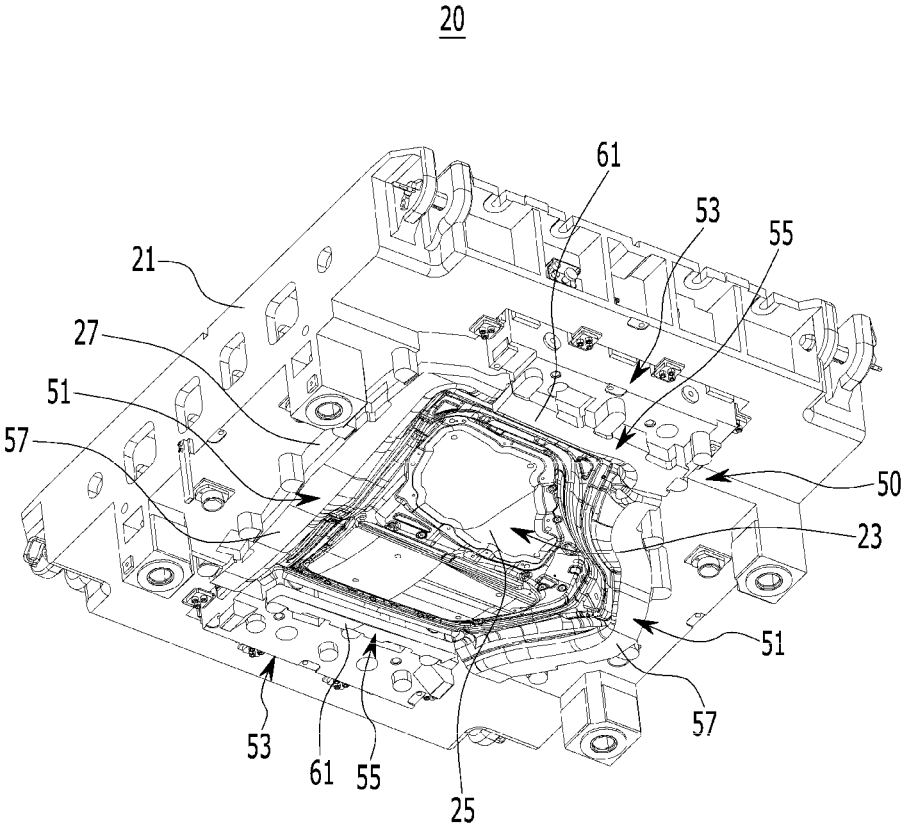
FIG. 7 illustrates an upper die applied to a press mold according to an embodiment of the present disclosure.

The upper die 20 includes an upper forming steel 23 provided on a lower surface of the upper body 21 as illustrated in FIG. 7. The upper forming steel 23 is formed by forming the blank plate 3 (see FIG. 5) into a predetermined shape, and has an upper forming surface 25 that forms a lower surface of the vehicle body part 1 (see FIG. 1) on a lower surface thereof. The upper forming steel 23 is installed on a lower surface of the mount base 27 at a center of a lower surface of the upper body 21.

Referring to FIG. 3 to FIG. 5, in the embodiment of the present disclosure, the lower holding unit 30 is provided as a lower blank holder that supports front-rear edge portions and up-down edge portions of the vehicle body part 1 (see FIG. 1) and the blank plate 3 (see FIG. 5) in the lower die 10.

The lower holding unit 30 is installed in the lower body 11 of the lower die 10, and is installed to be movable in the lower body 11 at an edge of the lower forming steel 13 in the vertical direction.

Figure 8:
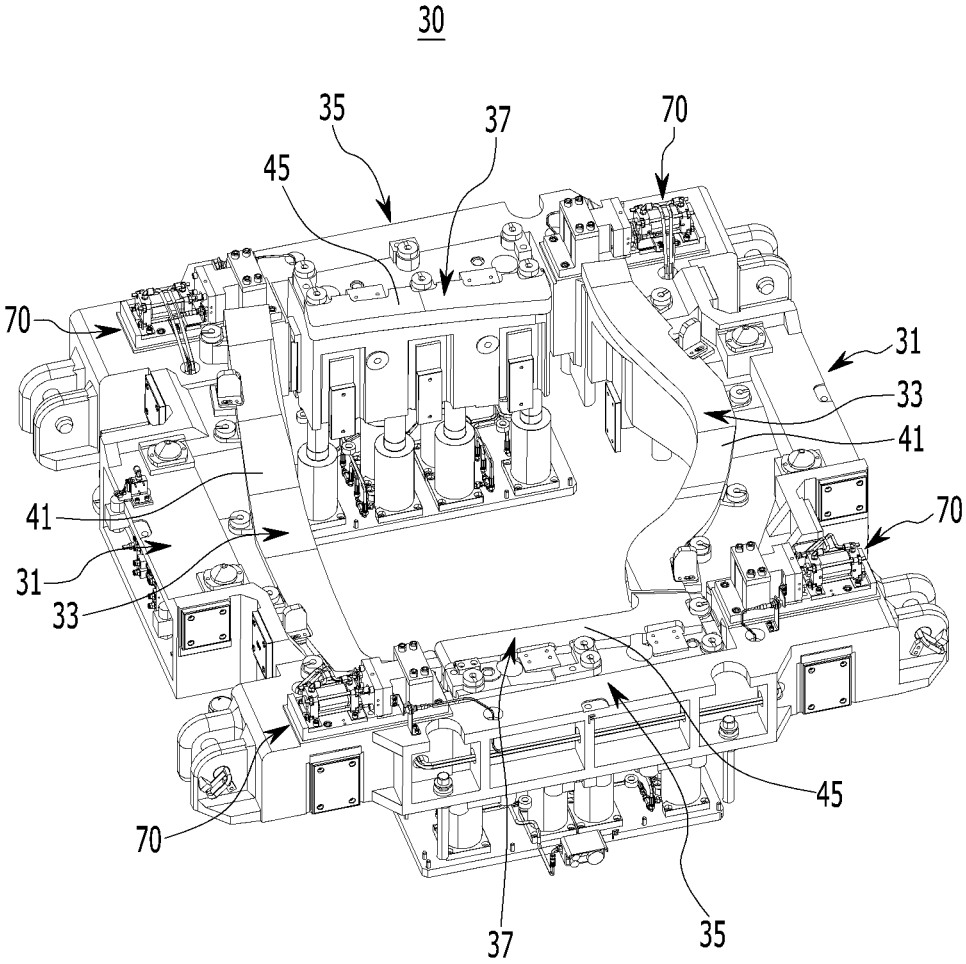
FIG. 8 and FIG. 9 illustrate a lower holding unit applied to a press mold according to an embodiment of the present disclosure.
Figure 9:
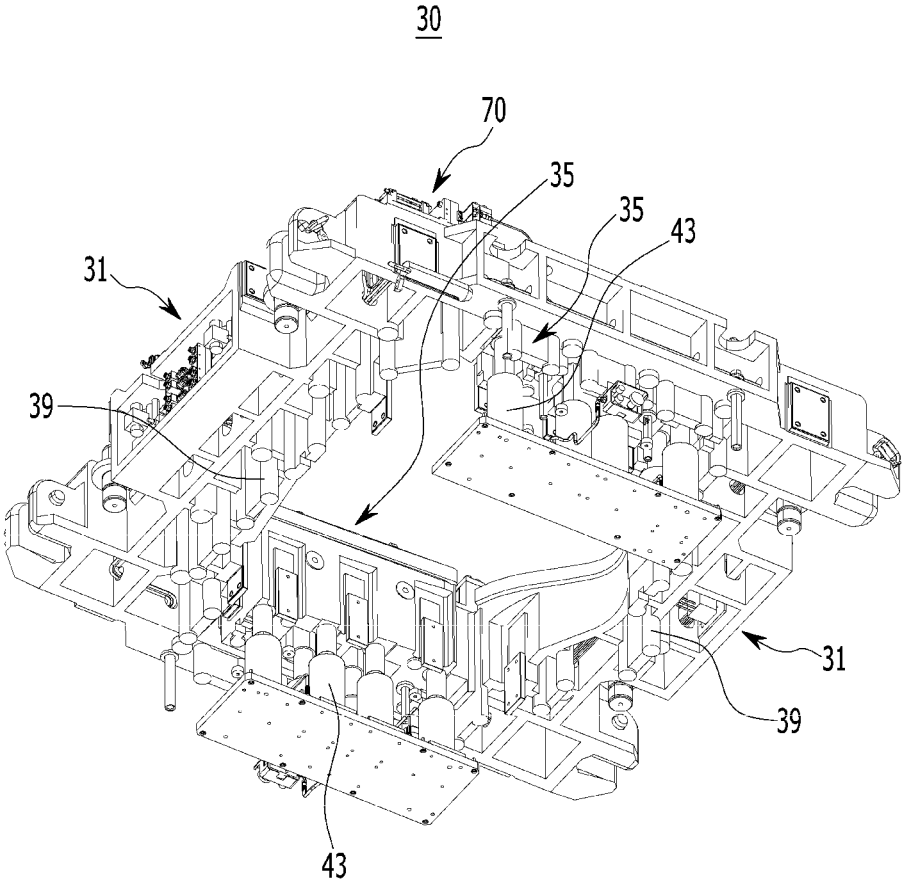

FIG. 8 and FIG. 9 illustrate a lower holding unit applied to a press mold according to an embodiment of the present disclosure.

Referring to FIG. 8 and FIG. 9, as well as FIG. 3 to FIG. 5, in an embodiment of the present disclosure, the lower holding unit 30 includes a pair of lower main blocks 31, lower main pads 33 connected to the lower main blocks 31, a pair of lower sub-blocks 35, and lower sub-pads 37 connected to the lower sub-blocks 35.

The lower main blocks 31 are disposed on the lower body 11 to face each other in a single direction with the lower forming steel 13 therebetween. The lower main blocks 31 are installed to be movable in the vertical direction on the lower body 11 through a plurality of first cushion springs 39.

The lower main pads 33 are integrally connected to the lower main blocks 31. The lower main pads 33 may support the front-rear edge portions of the vehicle body part 1 and the blank plate 3.

The lower main pads 33 are disposed to face each other in a single direction with the lower forming steel 13 therebetween. The lower main pads 33 form a first pad surface 41 supporting the front-rear edge portions of the vehicle body part 1 and the blank plate 3.

The lower sub-blocks 35 are disposed on the lower body 11 to face each other in another single direction that is perpendicular to the single direction with the lower forming steel 13 therebetween. The lower sub-blocks 35 are installed to be movable in the vertical direction on the lower body 11 through a plurality of second cushion springs 43.

The lower main pads 37 are integrally connected to the lower sub-blocks 35. The lower sub-pads 37 may support the up-down edge portions of the vehicle body component 1 and the blank plate 3.

The lower sub-pads 37 are disposed to face each other in another single direction that is perpendicular to the single direction with the lower forming steel 13 therebetween. The lower sub-pads 37 form a second pad surface 45 supporting the up-down edge portions of the vehicle body part 1 and the blank plate 3.

Herein, the first pad surface 41 of the lower main pads 33 as described above has a larger area than the second pad surface 45 of the lower sub-pads 37. In addition, in the above, the first cushion springs 39 elastically supporting the lower main blocks 31 have a spring elastic force that is greater than the second cushion springs 43 elastically supporting the lower sub-blocks 35.

Furthermore, since the first cushion springs 39 and the second cushion springs 43 as described above are made of a cushion spring for a blank holder that is well known in the art, a more detailed description will be omitted from this disclosure.

Referring to FIG. 3 to FIG. 5 and FIG. 7 to FIG. 9, in an embodiment of the present disclosure, the upper holding unit 50 is provided as an upper blank holder that supports the front-rear edge portions and the up-down edge portions of the vehicle body part 1 and the blank plate 3 in the upper die 20.

The upper holding unit 50 is provided in the upper die 20. The upper holding unit 50 includes a pair of upper main pads 51, a pair of upper sub-blocks 53, and upper sub-pads 55 connected to the upper sub-blocks 53.

The upper main pads 51 are integrally connected to an edge of the upper forming steel 23 in correspondence with the lower main pads 33 of the lower holding unit 30. The upper main pads 51 support the front-rear edge portions of the vehicle body part 1 and the blank plate 3.

The upper main pads 51 are disposed to face each other in a single direction with the upper forming steel 23 therebetween. The upper main pads 51 form a third pad surface 57 supporting the front-rear edge portions of the vehicle body part 1 and the blank plate 3. The third pad surface 57 is formed to correspond to the first pad surface 41 of the lower main pads 33.

The upper sub-blocks 53 are installed to be movable in the vertical direction on the upper body 21 at the edge of the upper forming steel 23 in correspondence with the lower sub-blocks 35 of the lower holding unit 30.

The upper sub-blocks 53 are disposed to face each other in another single direction that is perpendicular to the single direction with the upper forming steel 23 therebetween. The lower sub-blocks 53 are installed to be movable in the vertical direction on the upper body 21 through third cushion springs 59 of a well-known technique.

The upper main pads 55 are integrally connected to the upper sub-blocks 53. The upper sub-pads 55 may support the up-down edge portions of the vehicle body component 1 and the blank plate 3.

The upper sub-pads 55 are disposed to face each other in another single direction that is perpendicular to the single direction with the upper forming steel 23 therebetween. The upper sub-pads 55 form a fourth pad surface 61 supporting the up-down edge portions of the vehicle body part 1 and the blank plate 3. The fourth pad surface 61 is formed to correspond to the second pad surface 45 of the lower sub-pads 37.

Herein, the third pad surface 57 of the upper main pads 51 as described above has a larger area than the fourth pad surface 61 of the upper sub-pads 55. In addition, in the above, the third cushion springs 59 elastically supporting the upper sub-blocks 53 have a spring elastic force that is smaller than the first cushion springs 39 elastically supporting the lower main blocks 31 and is greater than the second cushion springs 43 elastically supporting the lower sub-blocks 35.

Further, in an embodiment of the present disclosure, a cushion stroke CS1 (hereinafter, see FIG. 5) of the lower main pads 33 by the lower main blocks 31 as described above satisfies a sum of a cushion stroke CS2 (hereinafter, see FIG. 5) of the lower sub-pads 37 by the lower sub-blocks 35 and a cushion stroke CS3 (hereinafter, see FIG. 5) of the upper sub-pads 55 by the upper sub-blocks 53.

Furthermore, in an embodiment of the present disclosure, when the upper die 20 descends, i.e., when the lower die 10 and the upper die 20 are combined, the lower main blocks 31 descend by the larger cushion stroke CS1 than the cushion stroke CS2 of the lower sub-blocks 35, and the upper sub-blocks 53 rise with the cushion stroke CS3 that is set by the lower sub-blocks 35.

Referring to FIG. 2 to FIG. 4 and FIG. 8 and FIG. 9, in an embodiment of the present disclosure, when the upper die 20 is released from the lower die 10, i.e., when the upper die 20 is raised, the gap control assembly 70 serves to form gaps that are set between the lower main blocks 31 of the lower holding unit 30 and the upper sub-blocks 53 of the upper holding unit 50. The gap control assembly 70 is installed in the lower main blocks 31 of the lower holding unit 30.

Figure 10A:
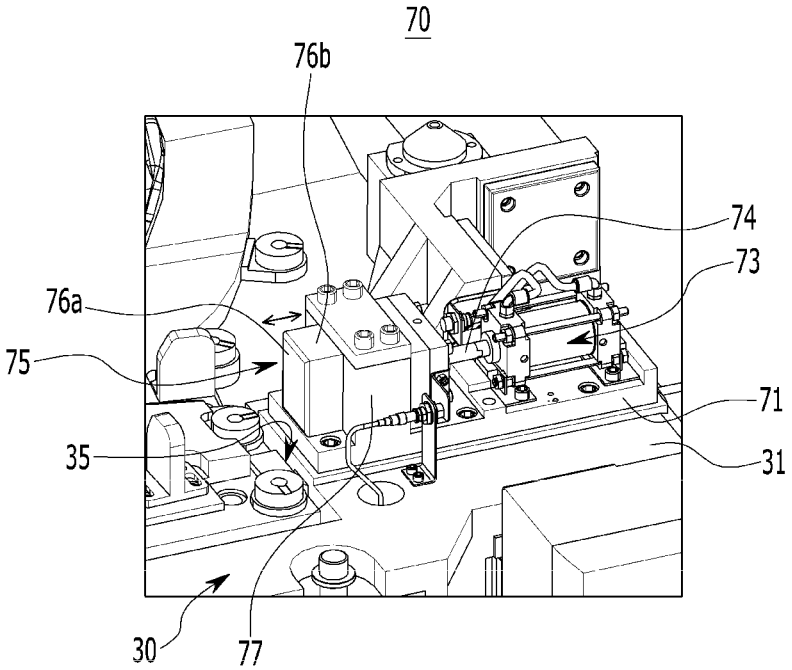
FIG. 10A and FIG. 10B illustrate a gap control assembly applied to a press mold according to an embodiment of the present disclosure.
Figure 10B:
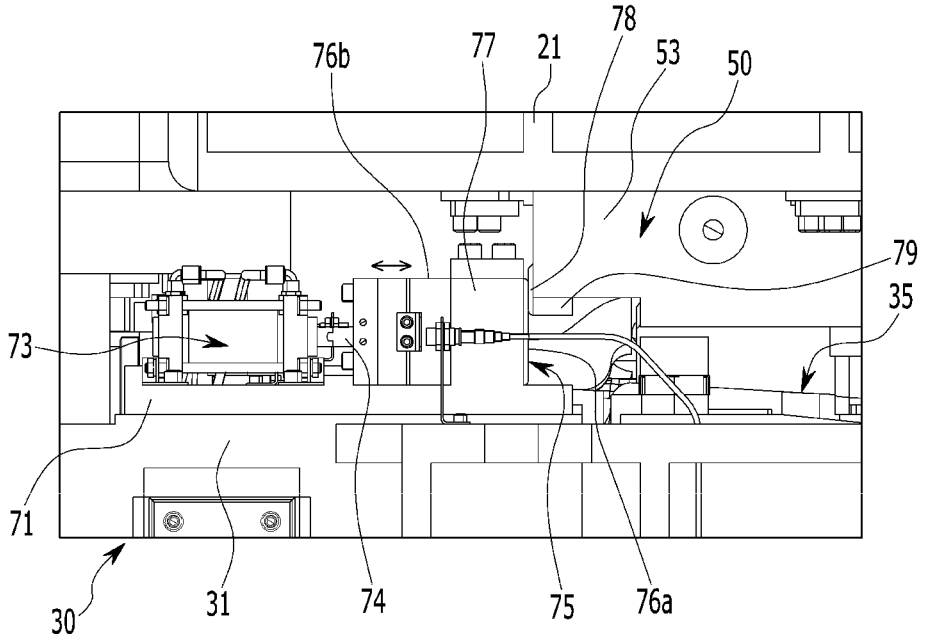

FIG. 10A and FIG. 10B illustrate a gap control assembly applied to a press mold according to an embodiment of the present disclosure.

Referring to FIG. 10A and FIG. 10B, according to an embodiment of the present disclosure, the gap control assembly 70 includes a base member 71, an air cylinder 73, a moving block 75, and a guide member 77.

The base member 71 is installed on an upper surface of the lower main blocks 31 to correspond to opposite sides of the lower sub-blocks 35 with the lower sub-blocks 35 therebetween in the lower holding unit 30.

The air cylinder 73 has an operation rod 74 that moves backward and forward along a longitudinal direction of the lower sub-pads 37, and is fixedly installed on the upper surface of the base member 71.

The moving block 75 is provided in the form of a quadrangular block, is connected to the operation rod 74 of the air cylinder 73, and is installed on the upper surface of the base member 71 so as to be movable back and forth.

In addition, the guide member 77 serves to guide the forward and backward movement of the movable block 75 on the base member 71, and is provided in a shape that allows the moving block 75 to pass forward and backward to be fixed to the upper surface of the base member 71.

On the other hand, stopper plates 78 are respectively installed in surface contact with a side surface 76*a* of the moving block 75 in the front-rear direction at opposite sides of the upper sub-blocks 53, in response to the moving block 75 as described above.

In addition, stopper blocks 79 are provided in surface contact with an upper surface 76*b* of the moving block 75 in the vertical direction at opposite sides of the upper sub-blocks 53.

Accordingly, when the upper die 20 is raised, i.e., when the lower die 10 and the upper die 20 are released, the lower main blocks 31 may maintain the upper sub-blocks 53 and a set gap G as the upper surface 76*b* of the moving block 75 is stopped by the stopper blocks 79.

That is, in an embodiment of the present disclosure, the lower main blocks 31 may be raised together with the upper sub-blocks 53 by the cushion stroke CS3 of the upper sub-blocks 53 as the gap G is formed between the lower main blocks 31 and the upper sub-blocks 53 by the moving block 75.

Figure 11:
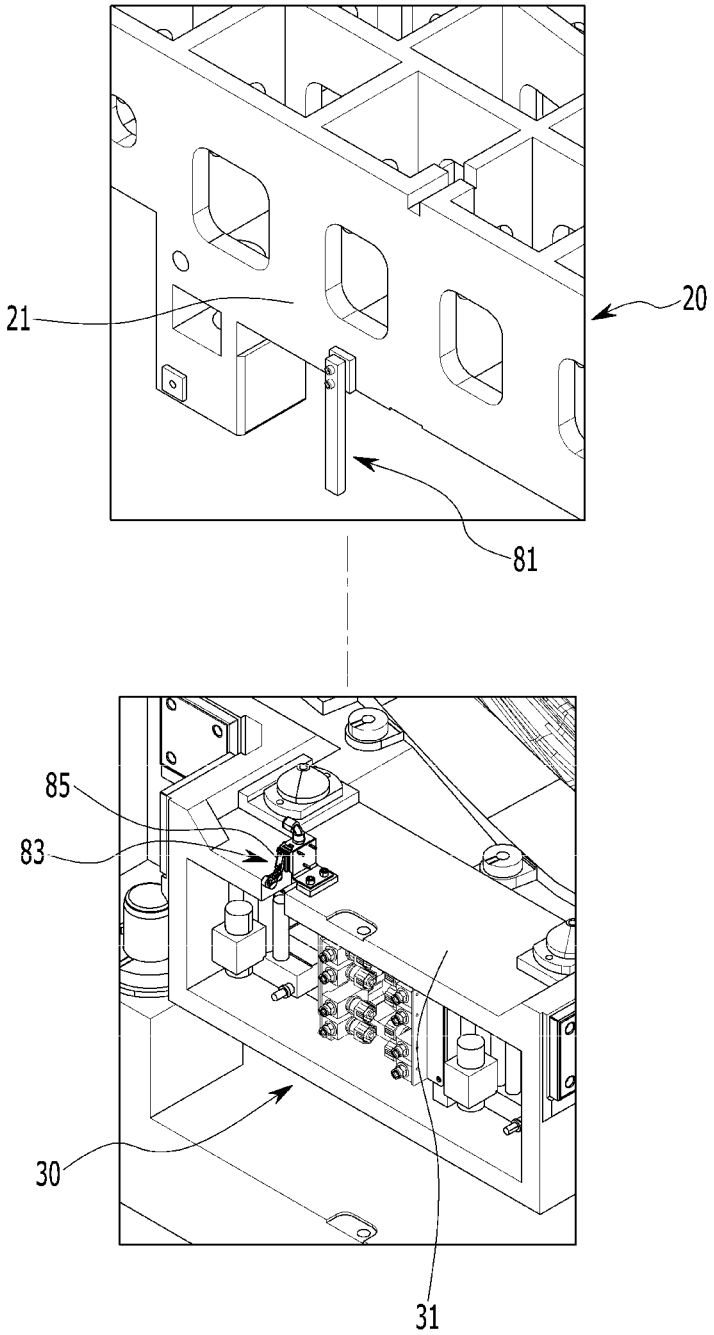
FIG. 11 illustrates peripheries of a switch touch block and a limit switch applied to a press mold according to an embodiment of the present disclosure.

On the other hand, in an embodiment of the present disclosure, as shown in FIG. 11, when the upper die 20 descends, a switch touch block 81 and a limit switch 83 for applying an electrical signal to the gap control assembly 70 (see FIG. 10A and FIG. 10B) as described above are further included.

The switch touch block 81 is provided in the form of a long rod in the vertical direction, and is fixedly installed on a side surface of the upper body 21 of the upper die 20 in the vertical direction.

The limit switch 83 serves to apply an electric operation signal to the gap control assembly 70 (see FIG. 10A and FIG. 10B) in a touch switching way by the switch touch block 81.

The limit switch 83 is installed in the lower main block 31 of the lower holding unit 30 in correspondence with the switch touch block 81. The limit switch 83 includes a switch touch block 81 and a touchable switch lever 85.

The switch lever 85 may be touched by the switch touch block 81, and may open and close a switch circuit of the limit switch 83.

Hereinafter, an operation and an action of the press mold 100 according to an embodiment of the present disclosure configured as described above will be described in detail with reference to the previously disclosed drawings and the accompanying drawings.

Figure 12:
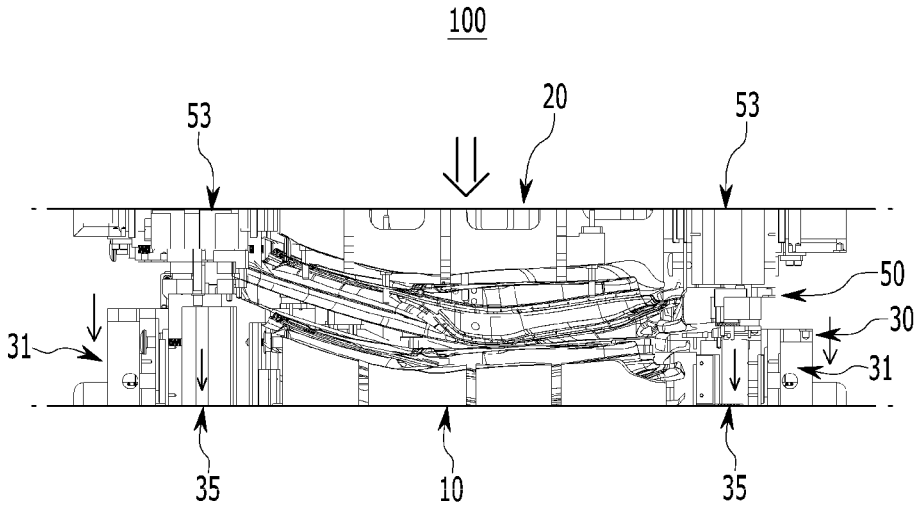
FIGS. 12, 13A-13B, and 14 illustrate views for describing an operation of a press mold according to an embodiment of the present disclosure.
Figure 13A:
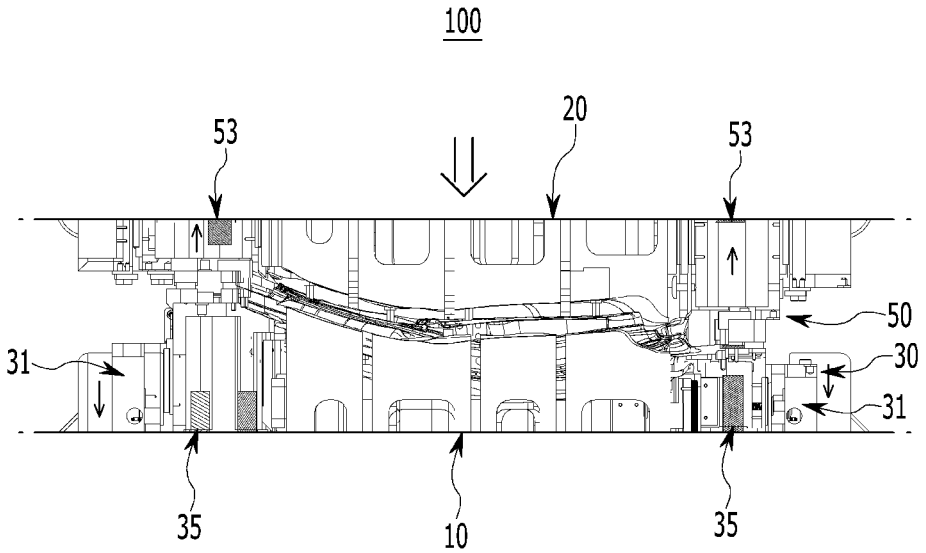
Figure 13B:
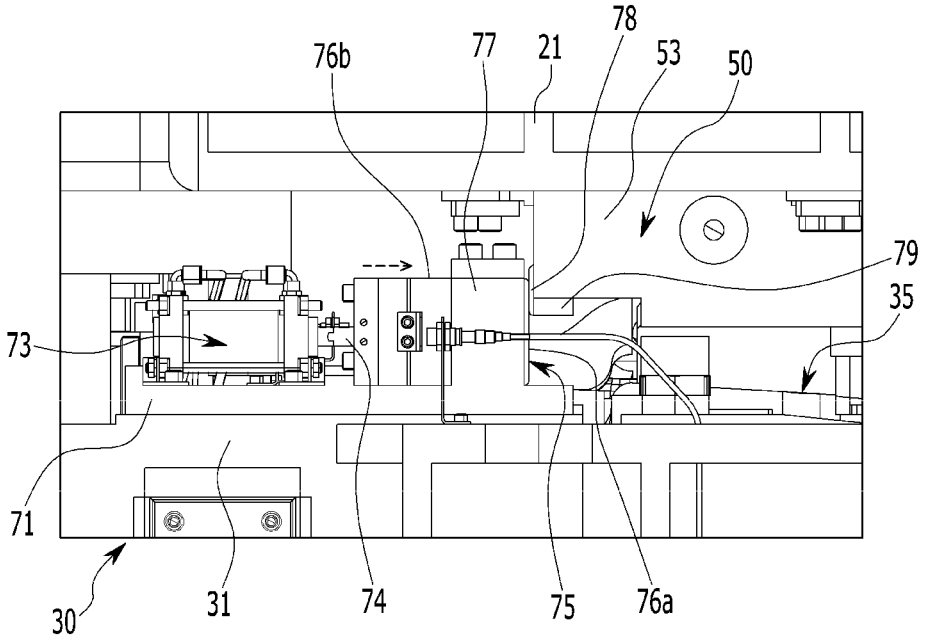
Figure 14:
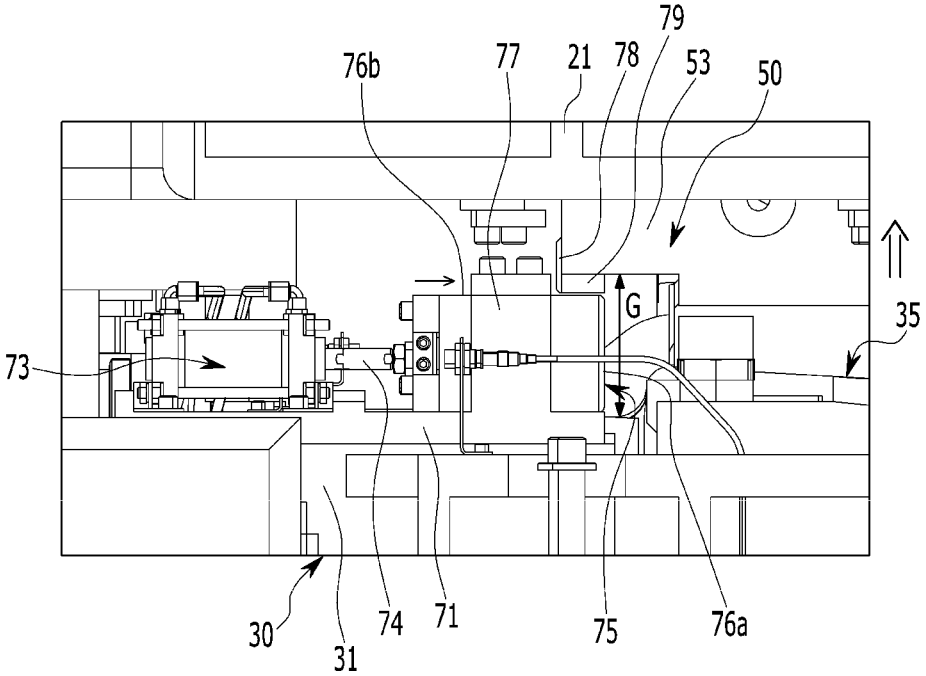

FIG. 12 to FIG. 14 illustrate views for describing an operation of a press mold according to an embodiment of the present disclosure.

Referring to FIG. 5, first, in an embodiment of the present disclosure, the upper die 20 is moved upward with respect to the lower die 10 through the slider.

Herein, the lower main pads 33 and the lower sub-pads 37 of the lower holding unit 30 are moved upward by the first and second cushion springs 39 and 43. In addition, the upper sub-pads 55 of the upper holding unit 50 are moved downward by the third cushion springs 59. Furthermore, the moving block 75 of the gap control assembly 70 is in a state of being moved backward by a backward operation of the air cylinder 73.

In the state as described above, in an embodiment of the present disclosure, the blank plate 3 made of aluminum is placed on the lower holding unit 30. In this case, the lower main pads 33 and the lower sub-pads 37 support edge portions of the blank plate 3 through the first and second pad surfaces 41 and 45.

Next, in an embodiment of the present disclosure as illustrated in FIG. 12, the upper die 20 is moved in a downward direction through the slider. In this process, the upper main pads 51 and the upper sub-pads 55 of the upper holding unit 50 hold edge portions of the blank plate 3 supported on the first and second pad surfaces 41 and 45 of the lower main pads 33 and the lower sub-pads 37 through the third and fourth pad surfaces 57 and 61.

Herein, the lower sub-pads 37 and the upper sub-pads 55 minimize an inflow of an edge portion of the blank plate 3 through the second and fourth pad surfaces 45 and 61, and hold the edge portion.

Subsequently, in an embodiment of the present disclosure, the upper die 20 is continuously moved downward. Then, in an embodiment of the present disclosure, the upper main pads 51 and the upper sub-pads 55 of the upper holding unit 50 press the lower main pads 33 and the lower sub pads 37 with the edge portion of the blank plate 3 therebetween.

Accordingly, the lower main pads 33 and the lower sub-pads 37 compress the first and second cushion springs 39 and 43 and move downward at the same time. Herein, the lower main pads 33 and the lower sub-pads 37 are simultaneously moved downward by the set cushion stroke CS2 of the lower sub-pads 37.

In this case, the moving block 75 of the gap control assembly 70 is in surface contact with the stopper plates 78 at opposite sides of the upper sub-blocks 53 through the side surface 76*a*, and is in a stopped state.

Accordingly, in an embodiment of the present disclosure, the blank plate 3 may be formed from the lower forming steel 13 of the lower die 10 and the upper forming steel 23 of the upper die 20 as much as the cushion stroke of the lower main pads 33 and the lower sub-pads 37.

Next, in an embodiment of the present disclosure as illustrated in FIG. 13A and FIG. 13B, the upper die 20 is continuously moved in a downward direction. Then, the lower main pads 33 compress the first cushion springs 39 by the upper main pads 51, and move downward while leaving the lower sub-pads 37 as they are.

At the same time, the upper sub-pads 55 press the lower sub-pads 37, compress the third cushion springs 59 through the upper sub-blocks 53, and move upward.

Herein, the lower main blocks 31 move downward by the cushion stroke CS3 of the upper sub-blocks 53. The lower main blocks 31 resultantly move downward by the cushion stroke CS1 corresponding to a sum of the cushion stroke CS2 of the lower sub-blocks 35 and the cushion stroke CS3 of the upper sub-blocks 53.

Accordingly, in an embodiment of the present disclosure, the vehicle body part 1 is manufactured while the blank plate 3 is formed by the lower forming steel 13 of the lower die 10 and the upper forming steel 23 of the upper die 20 as the lower die 10 and the upper die 20 are combined.

In an embodiment of the present disclosure, in the above-described process, the switch touch block 81 touches a switch lever 85 of the limit switch 83. Accordingly, in an embodiment of the present disclosure, an electrical operation signal is applied to the air cylinder 73 of the gap control assembly 70 by a controller (not illustrated) that has received a switching signal of the limit switch 83.

At the same time, in an embodiment of the present disclosure, the upper die 20 is raised upward, and as illustrated in FIG. 14, the moving block 75 is moved forward by a forward operation of the air cylinder 73.

Herein, when the upper die 20 is raised, the lower main blocks 31 are moved upward by the cushion stroke CS3 of the upper sub-blocks 53 by an elastic restoring force of the first cushion springs 39 while the upper sub-blocks 53 are restored by an elastic restoring force of the third cushion springs 59.

However, in an embodiment of the present disclosure, the gap G set between the lower main blocks 31 and the upper sub-blocks 53 is maintained by stopping the upper surface 76*b* of the moving block 75 by the stopper blocks 79 of the upper sub-blocks 53 as the moving block 75 is moved forward as described above.

Accordingly, in an embodiment of the present disclosure, the lower main blocks 31 may be raised together with the upper sub-blocks 53 by the cushion stroke CS3 of the upper sub-blocks 53 as the gap G is formed between the lower main blocks 31 and the upper sub-blocks 53 by the moving block 75.

Accordingly, in an embodiment of the present disclosure, it is possible to prevent a change in a gap between the lower main pads 33 and the upper sub-pads 55 from occurring due to a difference in elastic force between the first cushion springs 39 supporting the lower main blocks 31 and the third cushion springs 59 supporting the upper sub-blocks 53.

Accordingly, in an embodiment of the present disclosure, it is possible to prevent deformation of the edge portions of the vehicle body part 1 held by the lower main pads 33 and the upper sub-pads 55, respectively.

Meanwhile, when the upper die 20 is released from the lower die 10 through the above process, in an embodiment of the present disclosure, the lower main pads 33, the lower sub-pads 37, and the upper sub-pads 55 are restored to their original positions, so that the vehicle body part 1 can be taken out.

In accordance with the press mold 100 according to an embodiment of the present disclosure as described so far, the vehicle body part 1 as a non-ferrous part such as a door inner panel made of a non-ferrous material may be formed into a single piece by dividing a unit holding a blank and giving the holding unit a multi-cushion stroke.

Therefore, in an embodiment of the present disclosure, unlike the conventional art in which a plurality of pieces of blank plates are molded through each piece of press mold equipment, a production cost may be reduced.

Furthermore, in an embodiment of the present disclosure, it is possible to prevent the occurrence of wrinkles at corners of a vehicle body part by minimizing an inflow of material into a holding area through the lower sub-pads 37 of the lower holding unit 30 and the upper sub-pads 55 of the upper holding unit 50.

Furthermore, in an embodiment of the present disclosure, a depth of a die face of the mold may be reduced by dividing a unit holding a blank and giving the holding unit a multi-cushion stroke, and thus a blank material may be saved, thereby reducing a production cost.

While this disclosure has been described in connection with what is presently considered to be practical embodiments, it is to be understood that the disclosure is not limited to the disclosed embodiments, but, on the contrary, is intended to cover various modifications and equivalent arrangements included within the spirit and scope of the appended claims.

What is claimed is:

1. A press mold, comprising:

a lower die provided with a lower forming steel on an upper surface of a lower body;

an upper die provided with an upper forming steel on a lower surface of an upper body;

a lower holding unit including a pair of lower main blocks, a pair of lower main pads connected to the lower main blocks, and a pair of lower sub-pads respectively installed to be movable in an upper-lower direction on the lower body through first and second cushion springs, respectively, at an edge of the lower forming steel;

an upper holding unit including a pair of upper main pads integrally connected to an edge of the upper forming steel in correspondence with the lower main pads and upper sub-pads installed to be respectively movable in the upper body in the upper-lower direction through third cushion springs at the edge of the upper forming steel in correspondence with the lower sub-pads; and a plurality of gap control assemblies installed in the lower main blocks to form a gap set between the lower main blocks and upper sub-blocks connected to the upper sub-pads.

2. The press mold of claim 1, wherein a cushion stroke of the lower main pads satisfies a sum of cushion strokes of the lower sub-pads and the upper sub-pads.

3. The press mold of claim 1, wherein:

the lower main pads are disposed to face each other in a single direction with the lower forming steel therebetween, and the lower sub-pads are disposed to face each other in another single direction that is perpendicular to the single direction with the lower forming steel therebetween.

4. The press mold of claim 1, wherein:

the upper main pads are disposed to face each other in a single direction with the upper forming steel therebetween, and the upper sub-pads are disposed to face each other in another single direction that is perpendicular to the single direction with the upper forming steel therebetween.

5. The press mold of claim 1, wherein:

the lower main pads form a pad surface having a larger area than that of the lower sub-pads, and the upper main pads form a pad surface having a larger area than that of the upper sub-pads.

6. The press mold of claim 1, wherein:

the lower main blocks are installed to be movable in the upper-lower direction on the lower body through the first cushion springs, and the lower sub-pads are connected to lower sub-blocks and the lower sub-blocks are installed to be movable in an upper-lower direction on the lower body through the second cushion springs.

7. The press mold of claim 6, wherein the upper sub-blocks are installed to be movable in the upper-lower direction on the upper body through the third cushion springs.

8. The press mold of claim 7, wherein when the upper die descends, the lower main blocks descend by a larger cushion stroke than a cushion stroke of the lower sub-blocks, and the upper sub-blocks are raised by a cushion stroke that is set by the lower sub-blocks.

9. The press mold of claim 1, further comprising:

a switch touch blocks installed in the upper body; and a limit switch installed in the lower holding unit in correspondence with the switch touch block.

10. The press mold of claim 1, wherein each of the plurality of gap control assemblies includes:

a base member installed in the lower main blocks in correspondence with opposite sides of the lower sub-blocks with the lower sub-blocks therebetween;

an air cylinder installed in the base member to include an operation rod that operates forward and backward along a longitudinal direction of the lower sub-pads; and a moving block connected to the operation rod and installed to be movable back and forth on an upper surface of the base member.

11. The press mold of claim 10, wherein each of the gap control assemblies includes a guide member installed on the upper surface of the base member to guide the moving block.

12. The press mold of claim 10, wherein stopper plates are installed at opposite sides of the upper sub-blocks to be in surface contact with a side surface of the moving block in a front-rear direction.

13. The press mold of claim 12, wherein stopper blocks are provided at opposite sides of the upper sub-blocks to be in surface contact with a side surface of the moving block in an up-down direction.

14. The press mold of claim 10, wherein when the upper die is raised, the lower main blocks maintain a predetermined gap with the upper sub-blocks by the moving block.

* * * * *